US010612252B2

(12) United States Patent
Kudinov

(10) Patent No.: US 10,612,252 B2
(45) Date of Patent: Apr. 7, 2020

(54) TOOL AND METHODS FOR INSTALLATION OF INTERIOR PANELS

(71) Applicants: Yuriy Kudinov, Ottawa, Ontario (CA); Javed M. Somra, Manotick, Ontario (CA)

(72) Inventor: Yuriy Kudinov, Ottawa (CA)

(73) Assignees: Yuriy Kudinov, Ottawa, Ontario (CA); Javed M. Somra, Manotick, Ontario (CA)

( * ) Notice: Subject to any disclaimer, the term of this patent is extended or adjusted under 35 U.S.C. 154(b) by 0 days.

(21) Appl. No.: 15/840,591

(22) Filed: Dec. 13, 2017

(65) Prior Publication Data

US 2018/0171647 A1 Jun. 21, 2018

(30) Foreign Application Priority Data

Dec. 15, 2016 (CA) ..... 2951825

(51) Int. Cl.
*E04F 21/18* (2006.01)

(52) U.S. Cl.
CPC ..... *E04F 21/1822* (2013.01); *E04F 21/1844* (2013.01)

(58) Field of Classification Search
CPC ... E04F 21/1822; E04F 21/18; E04F 21/1805; E04F 21/1844; E04F 21/1877; E04F 21/1883; E04F 21/1894
USPC ..... 414/10–12
See application file for complete search history.

(56) References Cited

U.S. PATENT DOCUMENTS

| | | | | | |
|---|---|---|---|---|---|
| 2,472,887 | A * | 6/1949 | Core | E04F 21/1822 | 254/387 |
| 3,642,150 | A * | 2/1972 | Zizak | E04F 21/1822 | 248/229.12 |
| 4,709,527 | A * | 12/1987 | Cooley | E04B 9/22 | 52/127.2 |
| 5,163,799 | A * | 11/1992 | Lynn | E04F 21/1822 | 248/351 |
| 5,320,470 | A * | 6/1994 | Russell | E04F 21/1822 | 248/351 |
| 2004/0182019 | A1* | 9/2004 | Flynn | E04F 21/1805 | 52/127.2 |
| 2005/0217157 | A1* | 10/2005 | Valette | E04F 21/1822 | 40/650 |
| 2006/0218868 | A1* | 10/2006 | Lewis | E04F 21/185 | 52/127.2 |
| 2007/0102614 | A1* | 5/2007 | McKinney | E04F 21/1805 | 248/351 |

* cited by examiner

*Primary Examiner* — Lynn E Schwenning
(74) *Attorney, Agent, or Firm* — James Creighton Wray

(57) ABSTRACT

The present drywall installation tool is configured to facilitate the installation of interior panels such as drywall, plywood or any applicable material on horizontal and vertical framed surfaces and to avoid the necessity of having more than one person to install each drywall panel and without using the floor as a supportive base for the installation tool.

11 Claims, 8 Drawing Sheets

TOOL AND METHODS FOR INSTALLATION OF INTERIOR PANELS

FIELD OF THE INVENTION

The present invention refers to construction field as a tool operable by one person and methods providing an installation of interior panels on vertical and horizontal framed surfaces without using the floor as a supportive base for the tool.

BACKGROUND OF THE INVENTION

According to practical experience construction site is usually filled up with stocks of construction materials such as lumber, packs of drywalls, etc., as well as construction tools and equipment. Existing drywall installation devices are floor-based and require the floor to be totally unoccupied with anything in order to operate installation equipment safely.

Technologically ceiling panels supposed to be installed first. So, to install for example 5 boards on the ceiling of some room installer often have to remove 25 or so other panels as well as another staff out of his way. It can take much more time and efforts to clean the room prior to installation than installation process itself.

Due to operational complexity and dimensional features of existing drywall installation devices transportation, deployment and usage of it contribute to efficiency losses as well.

As a result many installers prefer or forced to do drywall installation manually. However for that one installer likely will not be able to do most of the job on his own, not speaking of physical efforts required for that.

Shortcomings mentioned above reveal some space for improvement.

SUMMARY OF THE INVENTION

This invention related to one person operable tool and designated for installation of interior panels on vertical and horizontal framed surfaces.

Functioning of invented tool based on the invented methods for mounting of interior panels, meaning that invented tool does not need the floor as supportive base and uses the ceiling and wall construction frames instead as a bearing structure.

Being compact, easy operable and reliably attachable to ceiling and wall frames according to invented methods the invented tool will allow to optimize interior panels installation process compare to existing tools and methods.

These and other features related to invention will be described specifically in the following detailed description and representative drawings.

DETAILED DESCRIPTION

Apparatus

Figure 1:
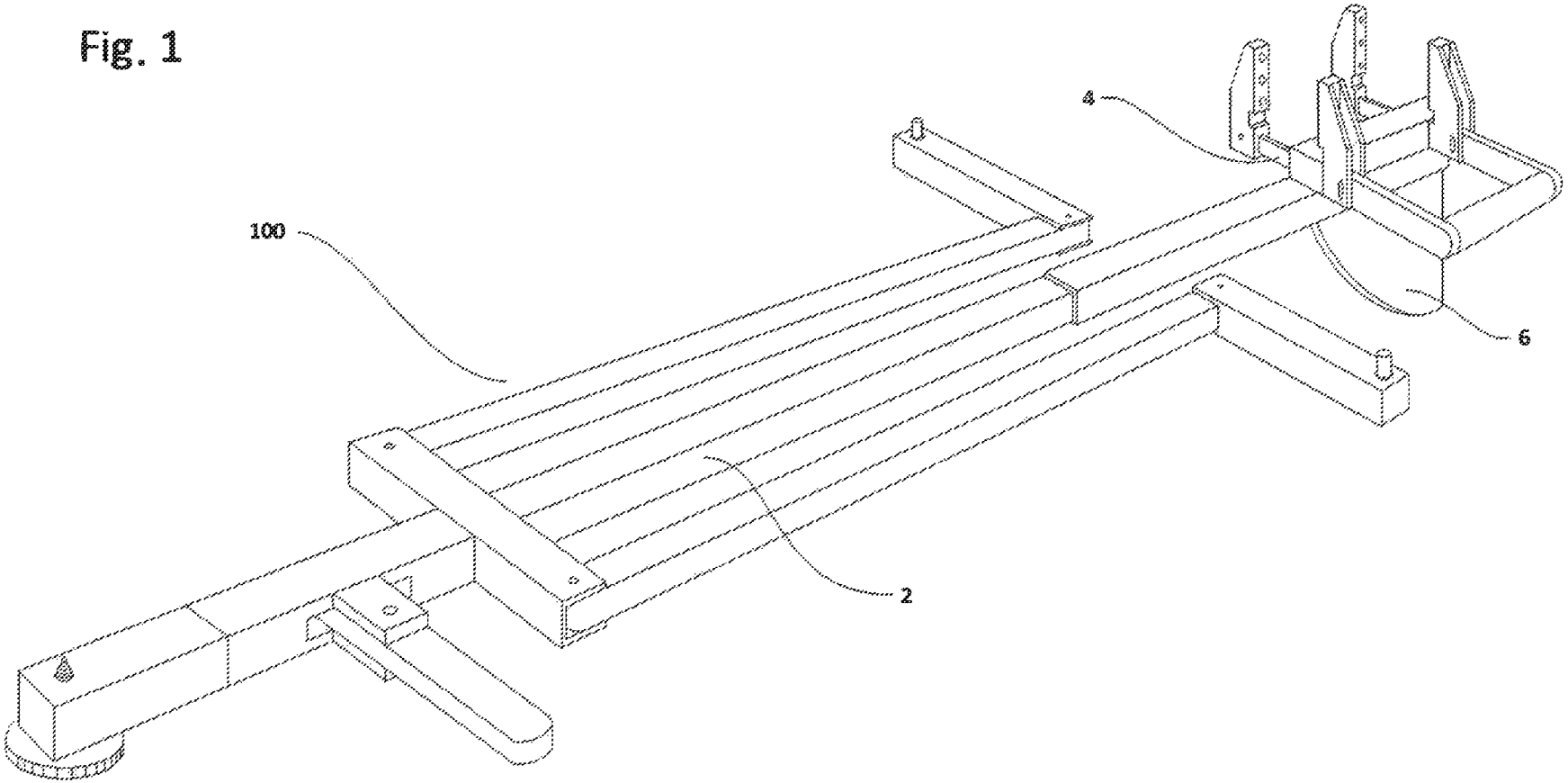
FIG. 1 is a general isometric view of the embodiment of the invented tool.
Figure 2:
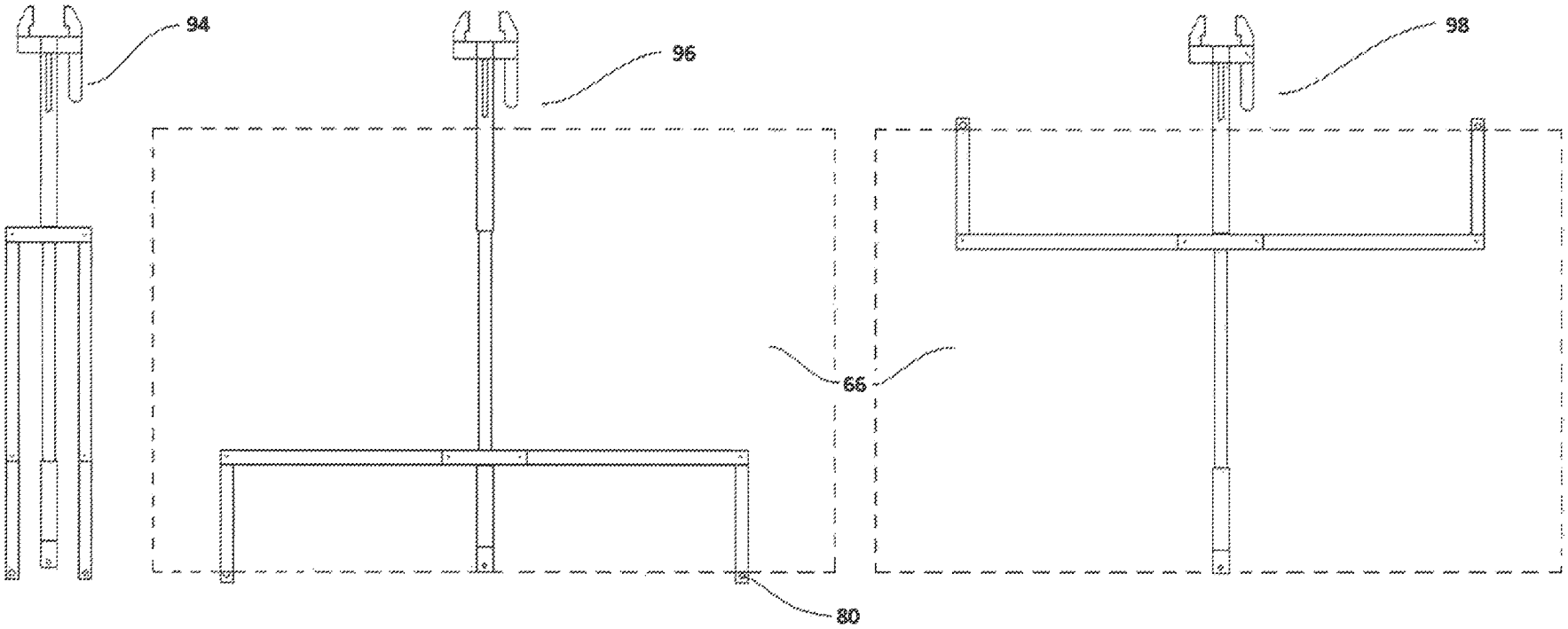
FIG. 2 is a schematic illustration of the framework transformation patterns from stowed position to ceiling or wall panel's installation positions, front view.

Referring to FIGS. 1 and 2, there is shown a tool 100 for installation of interior panels 66 on horizontal and vertical framed surfaces without using the floor as a supportive base. In the present implementation the tool 100 comprises three parts: clamp 4, quarter round junction 6 and framework 2.

Figure 1A:
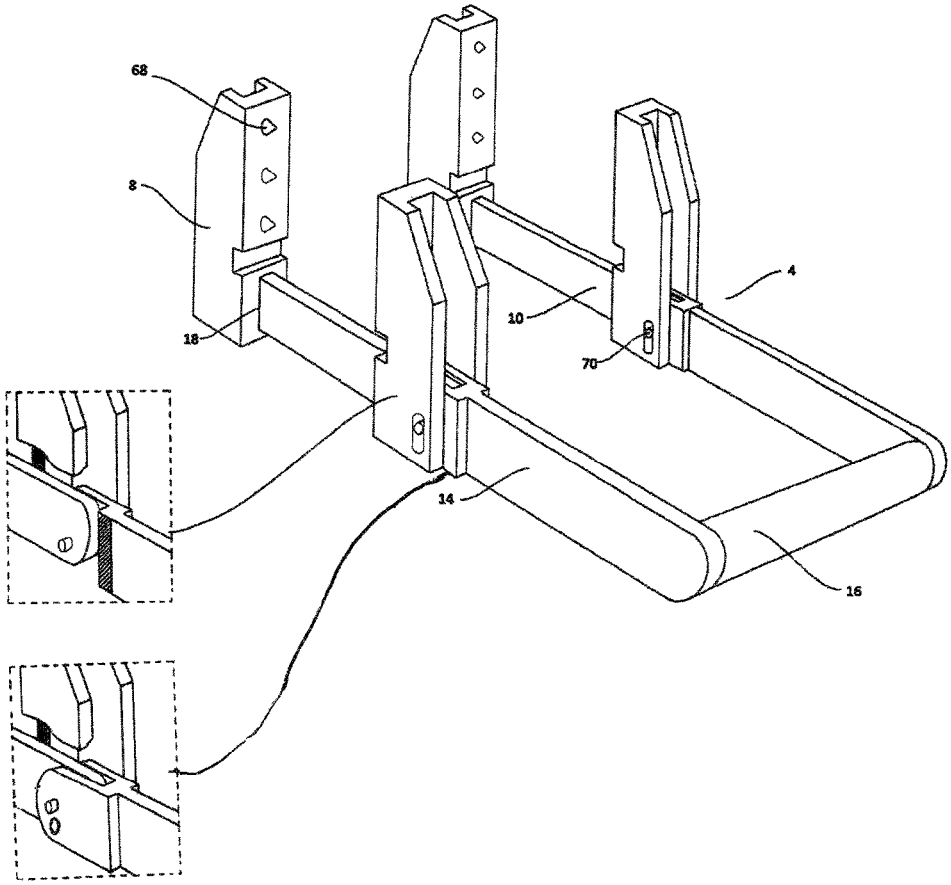
FIG. 1A is an isometric partial view of the embodiment of the invented tool illustrating a clamp.

Referring to FIG. 1A, the clamp 4 is illustrated in more detail and consists of: two sliding rods 10, two pairs of jaws 8, two compressing lever 14 connected together with a handle 16 and some fastening elements (not shown). It is intended for attachment of the tool 100 to all kinds of interior framing materials applicable in construction field.

The jaw 8 in the present invention is shaped as irregular enneagonal prism. Each jaw 8 has an antifriction counter side surface presently shown as a thorns 68 protruding of it and intended for partial penetration into construction frame material for reliable connection. Each jaw 8 has a sliding rod channel 18 by means of which the jaw 8 can move limitedly on the sliding rod 10.

Sliding rods 10 in the present embodiment are shaped as rectangular prism. The left side pair of jaws 8 can be fixed in certain positions on the sliding rods 10 which are predetermined by the size of the framing elements 64 used for attachment of the clamp 4. The right side pair of jaws 8 are eccentrically connected to compressing lever 14 and sliding rods 10 with shafts 70.

Compressing lever 14 in the present embodiment is shaped as a fork and joined together with handle 16. Due to eccentric connection with sliding rods 10 and jaw 8 the rotating movement of the compressing lever 14 which is caused manually by handle 16 will result in linear movement of the right side pair of jaw 8 on the sliding rod 10 toward the left side pair of jaw 8. The torque from compressing levers 14 provides penetration of antifriction elements of the counter side of jaw 8 into the frame material 102 or 104, previously placed between the left side and right side pairs of jaw 8.

Figure 1B:
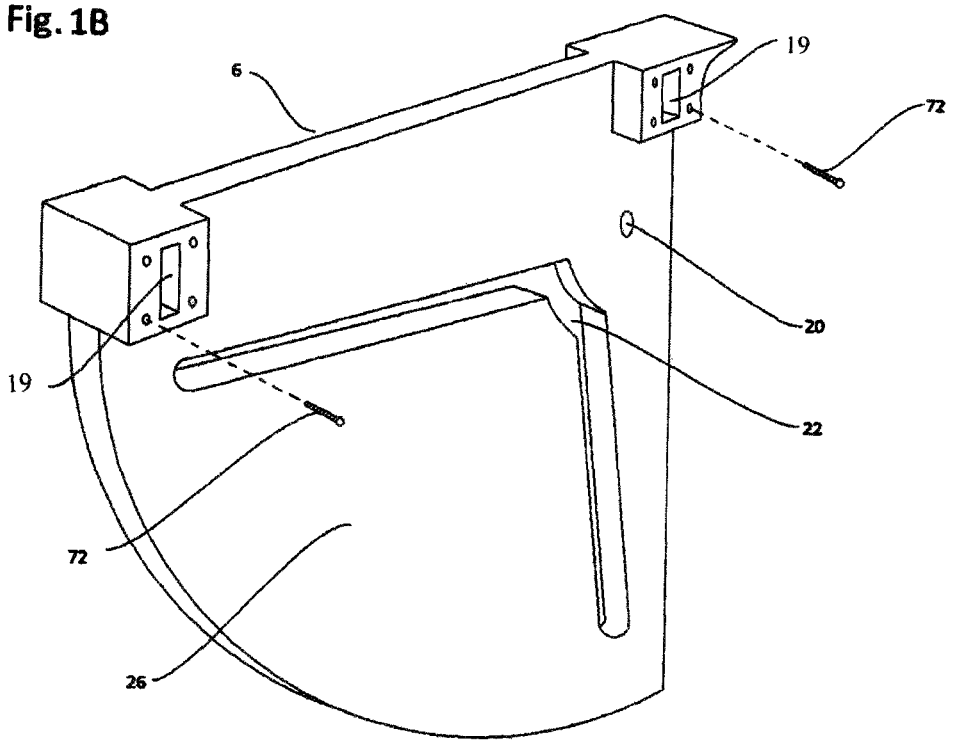
FIG. 1B is an isometric partial view of the embodiment of the invented tool illustrating a quarter round junction.

Referring to FIG. 1B, the quarter round junction 6 consists of quarter round guide 26 shaped in present embodiment as quarter round plate and fastening elements (bolts) 72 by means of which quarter round junction 6 is attached to the right side pair of jaw 8 described above. The quarter round junction 6 is intended to join parts of the tool 100 together and provides linear movement of sliding rods 10 through it as well as sectoral movement of the framework 2.

The quarter round guide 26 contains: two sliding rod channels 19, main pivot channel 20 and levelling channel 22. Sliding rod channels 19 are intended for the linear movement of the sliding rod 10 through it. Main pivot channel 20 is intended for connection of quarter round junction 6 with framework 2 and allows rotation of the framework 2 on the axis of main pivot 36 passing through main pivot channel 20. Levelling channel 22 is intended to guide and control an angle of elevation (depression) of the framework 2.

Figure 1C:
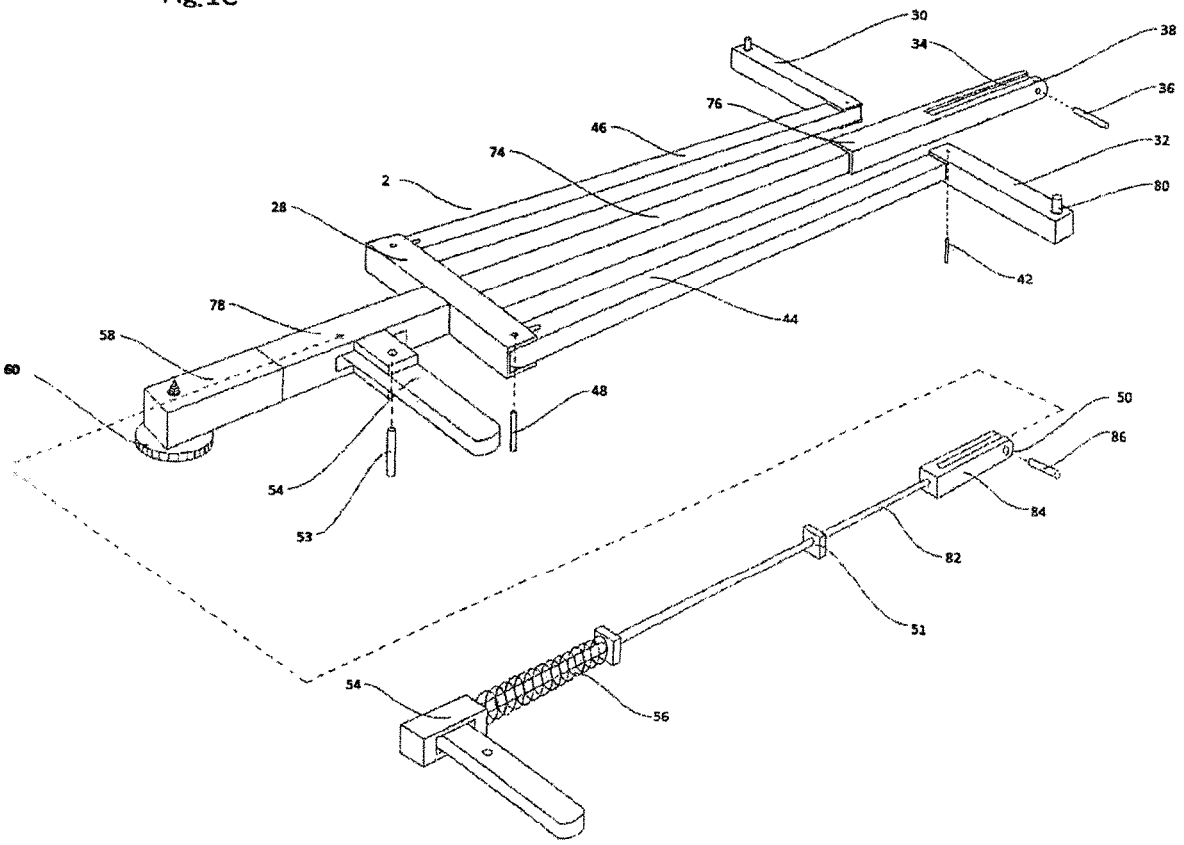
FIG. 1C is an isometric partial view of the embodiment of the invented tool illustrating a framework.

Referring to FIG. 1C, the framework 2 consists of: main arm 38, extension section 58, crossbar 28, right arm 44, right semi-arm 32, left arm 46, left semi-arm 30, levelling transmission 50 and is intended for support of an interior panel 66 during an installation process.

Main arm 38 in present embodiment is a rectangular tube consisting of three sections. Middle section 74 has a smaller profile size compare to sections on each of the ends. The first end section 76 contains quarter round guide channel 34 shaped as a slot intended to allow the quarter round guide 26 to slide inside it and main pivot channel 20 with main pivot 36 itself connecting main arm 38 to quarter round junction 6 and allowing rotating movement of the main arm 38 on the axis of main pivot 36. The second end section 78 is connected to extension section 58.

Extension section 58 in present embodiment is a rectangular tube containing security anchor 60 and providing some extension of the main arm 38 as well as additional connection of the tool 100 to the construction framing elements 102 or 104 by means of security anchor 60. Security anchor 60 in present embodiment is shaped as a screw with handle and intended to be screwed into the construction framing element 88 or previously installed panel 66 and framing element 102 or 104 during installation process.

Crossbar 28 in present embodiment is a rectangular tube placed on the middle section 74 of the main arm 38 and sliding on it due to rectangular channel in it within limits of middle section 74 of main arm 38.

Right arm 44 and left arm 46 in present embodiment are rectangular tubes connected to the ends of crossbar 28 with crossbar pivots 48 which allow limited rotation of right arm 44 and left arm 46 around axis of pivots. Due to smaller profile size of right arm 44 and left arm 46 compared to the crossbar 28 profile they also can partially slide inside crossbar 28 from the same axis position as a crossbar 28 and fixated.

Right semi-arm 32 and left semi-arm 30 in present embodiment are rectangular tubes connected to the right arm 44 and left arm 46 respectively by means of semi arm pivots 42 which are providing limited rotation of right semi-arm 32 and left semi-arm 30 on the axis of pivots. Semi-arms 32 and 30 contain supporting shaft 80 which are shaped as a cylinders sliding through semi-arms and having two fixed positions in which protrusion of supportive shaft 80 from the same sides of semi-arms 32 and 30 are provided. Supporting shafts 80 are intended for support of the interior panel 66 in pre-installation position.

Referring to FIG. 2, linear and/or circular motions of crossbar 28, right arm 44, left arm 46, right semi-arm 32, and left semi-arm 30 intended for transformation of the framework 2 prior to panel installation in order to provide support for the panels intended to be installed either on the ceiling 102 or on the wall framing elements 104.

Levelling transmission 50 is placed inside main arm 38 profile, consists of: mount 51, shaft 53, control lever unit 54, compression spring 56, rod 82, fork 84. Levelling transmission 50 is intended for fixation of the framework 2 relatively to quarter round junction 6 in pre-installation and installation positions and levelling of the framework 2 relatively to interior framing elements 102 or 104 in installation position. In order to provide those functions the fork 84, containing levelling shaft 86 in it, enfolds quarter round guide 26 so that the levelling shaft 86 passing through levelling channel 22 of the quarter round guide 26. This way the linear position of the levelling shaft 86 inside main arm 38 which is controlled by control lever unit 54 and compression spring 56 determine an angle of elevation (depression) of the framework 2 relatively to the clamp 4 and consequently to the construction framing elements 102 or 104 that clamp 4 is attached to. The shape of the levelling channel 22 allows to compensate relative deflection of the frame material caused by the load of the tool 100 with interior panel 66 on it as well as functioning of the tool 100 in regular (right-hand) and reversed (left-hand) connection of the tool 100 to the construction framing elements 102 or 104 that would be described specifically below.

Method of Operation

Figure 2A:
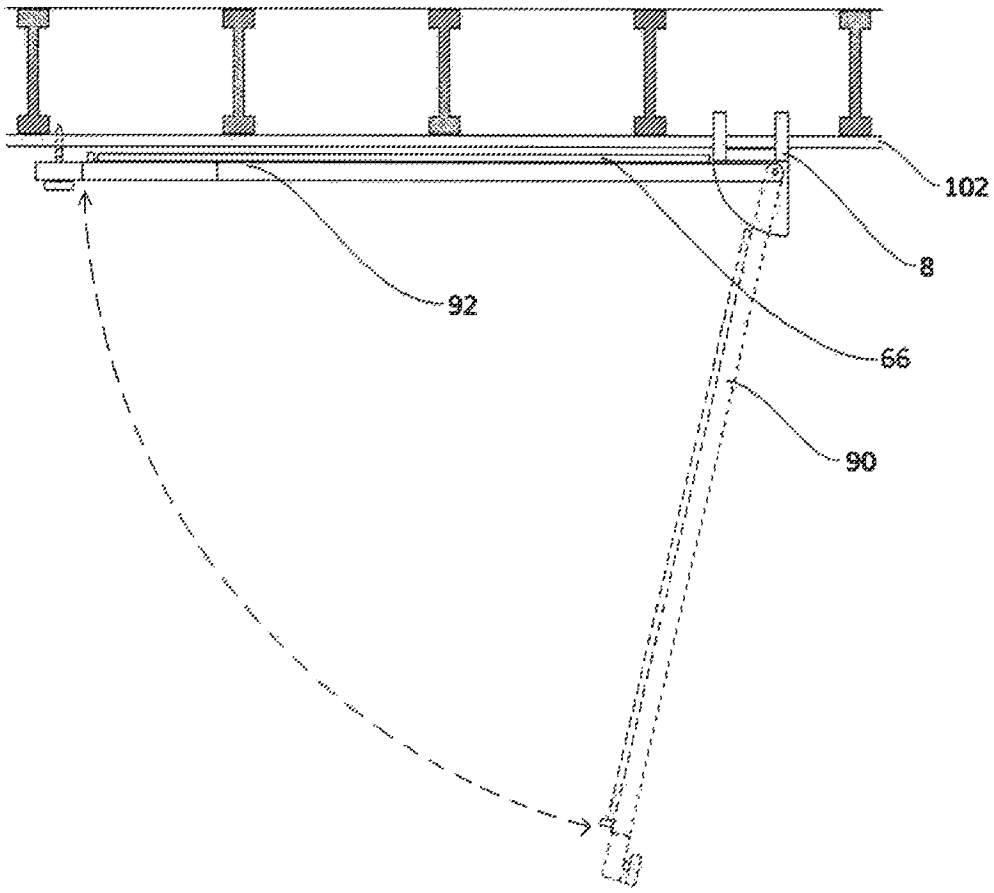
FIG. 2A is a schematic illustration of the method ceiling-to-ceiling for installation of interior panels on horizontal framed surfaces without using floor as a supportive base, showing the embodiment of the invented tool attached to the ceiling frame for ceiling panel installation, side view.
Figure 2B:
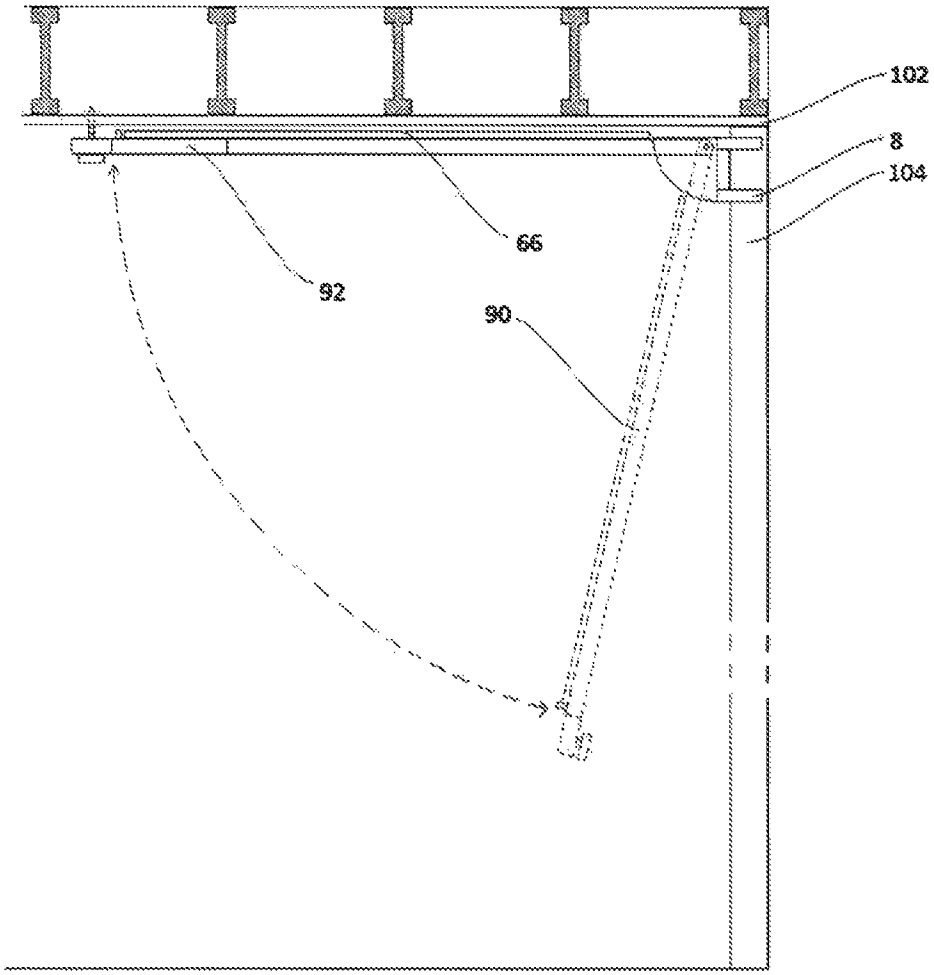
FIG. 2B is a schematic illustration of the method wall-to-ceiling for installation of interior panels on horizontal framed surfaces without using floor as a supportive base, showing the embodiment of the invented tool attached to the wall frame for ceiling panel installation, side view.
Figure 2C:
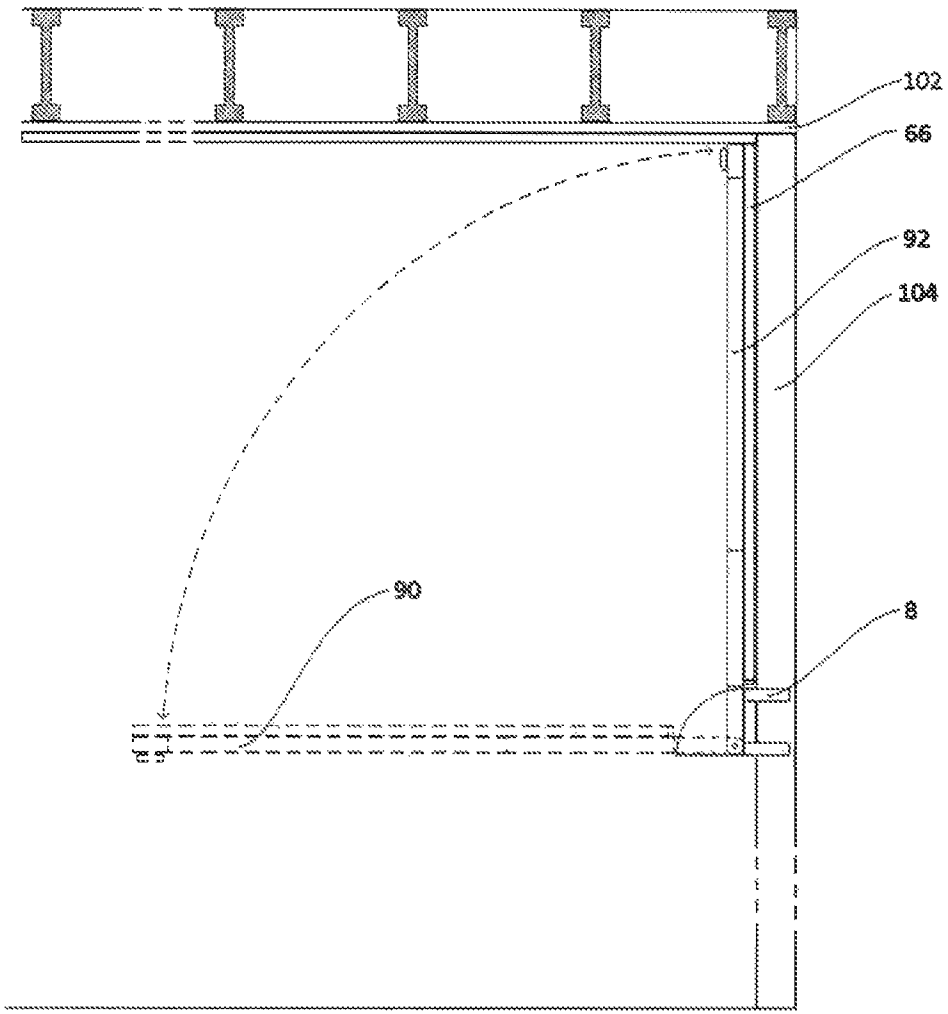
FIG. 2C is a schematic illustration of the method wall-to-wall for installation of interior panels on vertical framed surfaces without using floor as a supportive base, showing the embodiment of the invented tool 100 attached to the wall frame for wall panel installation, side view.

FIG. 2A, FIG. 2B and FIG. 2C show the methods for installation of interior panels 66 on horizontal and vertical framed surfaces without using a floor as a supportive base. They are intended for usage of the wall 104 and ceiling construction framing elements 102 as a bearing structure for attachment of the tool 100 for panel installation instead of using the floor as a supportive base.

Referring to FIG. 2A, FIG. 2B, and FIG. 2C, the pre-installation position 90 of the tool 100 is a position in which the tool 100 is attached to the construction framing elements 102 or 104 and the main arm 38 of the framework 2 is positioned within an angle of 45-90 degrees relative to the construction framing elements 102 or 104 intended for current panel installation. Pre-installation position 90 intended for loading of the framework 2 with interior panel 66.

Installation position 92 of the tool 100 is a position in which the tool 100 is attached to the construction framing elements 102 or 104 and the main arm 38 of the framework 2 is positioned within an angle close to 0 degrees relative to the construction framing elements 102 or 104 intended for current panel installation. Installation position is intended for attachment of the interior panel 66 to the construction framing elements 102 or 104.

Right-Hand Connection

Regular (right-hand) connection of the tool 100 to the construction framing elements 102 or 104 means attachment of the tool 100 to the construction framing elements 102 or 104 the way in which the main arm 38 being in installation position of the tool 100 is positioned within an angle close to 90 degrees relatively to the long side of the jaws 8.

Left-Hand Connection

Reversed (left-hand) connection of the tool 100 to the construction frame means attachment of the tool 100 to the construction framing elements 102 or 104 the way in which the main arm 38 being in installation position of the tool 100 is positioned within an angle close to 0 degrees relatively to the long side of the jaws 8.

Ceiling-to-Ceiling Method

FIG. 2A illustrates the ceiling-to-ceiling method of installation. In other words, attachment of the tool 100 to the horizontal (ceiling) construction framing elements 102 in order to install an interior panel 66 on the ceiling framing elements 102. For implementation of this method can be used tool 100 described above in the following order:

Right-hand connection of the tool 100 to the ceiling framing elements 102. For that, in order to determine the exact place of panel installation the tool 100 supposed to be placed closely to the ceiling framing element in installation position so that the extension section 58 of the framework 2 would touch the vertical construction frame at the beginning of the ceiling or previously installed panel and the jaw 8 of the clamp 4 embracing ceiling frame element 102. After that the clamp 4 supposed to be locked on the construction frame by manual circular movement of the handle 16;

Lowering of the framework 2 into pre-installation position 90 and deployment of the framework 2 in the ceiling panel installation pattern 94 and loading of it with an interior panel 66. The interior panel 66 supposed to be placed manually on the framework 2 so that supporting shaft 80 would restrict sliding of the interior panel 66 down;

Manual swing-up of the framework 2 preloaded with the panel 66 to installation position 92. Levelling transmission 50 will initially lock up the framework 2 once it is in installation position and the final levelling, necessary due to some deflection of the construction frame material caused by the load, supposed to be done manually by means of control lever unit 54;

Attachment of the security anchor 60. For that, extension section 58 supposed to be pulled out of the main arm 38 and attached by means of screwing of the security anchor 60 into the same construction framing element 102 the clamp 4 is attached to.

Adjustment and attachment of the interior panel 66 to the construction framing elements 102.

Wall-to-Ceiling Method

FIG. 2B illustrates the wall-to-ceiling method. In other words, attachment of an installation tool 100 to the vertical (wall) construction framing elements 104 in order to install an interior panel 66 on the ceiling framing elements 102. This method intended for installation of the first and the last panels 66 on the ceiling. For implementation of this method, the tool described above can be used in the following order:

Left-hand connection of the tool 100 to the wall framing element 88. For that the tool 100 in pre-installation position 90 supposed to be attached by means of the clamp 4 to the wall framing element 104 adjacent to the installation spot. For that the jaw 8 of the clamp 4 supposed to embrace wall framing element 104 in the maximum height position. After that the clamp 4 supposed to be locked on the framing element 104 by manual circular movement of the handle 16;

Deployment of the framework 2 in the ceiling panel installation pattern 96 and loading of it with an interior panel 66. The interior panel 66 is supposed to be placed manually on the framework 2 so that supporting shaft 80 would restrict sliding of the interior panel 66 down;

Manual swing-up of the framework 2 preloaded with the interior panel 66 to installation position 92. Levelling transmission 50 will initially lock up the framework 2 once it is in installation position 92 and the final levelling, necessary due to some deflection of the construction framing material caused by the load, supposed to be done manually by means of control lever unit 54;

Attachment of the security anchor 60. For that, extension section 58 supposed to be pulled out of the main arm 38 and attached by means of screwing of the security anchor 60 into the closest ceiling construction framing element 102.

Adjustment and attachment of the interior panel 66 to the ceiling framing elements 102.

Wall-to-Wall Method

FIG. 2C illustrates the wall-to-wall method. In other words, attachment of an installation tool 100 to the vertical (wall) construction framing elements 104 in order to install an interior panel 66 on the wall framing elements 104. For implementation of this method, the tool described above can be used in the following order:

Right-hand connection of the tool 100 to the wall framing element 104. For that, the tool 100 in installation position 92 supposed to be placed to the wall framing element 104 so that the end of extension section 58 of the framework 2 would touch the ceiling frame 102 and the jaw 8 of the clamp 4 would embrace the wall framing element 104. After that the clamp 4 supposed to be locked on the framing element by manual circular movement of the handle 16;

Deployment of the framework 2 in the wall panel installation pattern 98 and loading of it with an interior panel 66. The interior panel 66 supposed to be placed manually on the framework 2 so that supporting shaft 80 would restrict sliding of the interior panel 66 down;

Manual swing-up of the framework 2 preloaded with the interior panel 66 to installation position 92. Levelling transmission 50 will initially lock up the framework 2 once it is in installation position;

Adjustment and attachment of the interior panel 66 to the construction framing element 104.

For the best balance in all of the methods described above, the tool 100 supposed to be attached on the construction framing element 102 or 104 which is closest to the middle of the intended panel 66 position lengthwise.

The scope of the claims should not be limited by the preferred embodiments set forth in the examples, but should be given the broadest interpretation consistent with the description as a whole.

The embodiments of the invention in which an exclusive property or privilege is claimed are defined as follows:

1. An apparatus comprising a tool for installation of interior panels on vertical and horizontal framed surfaces without using a floor as a supportive base for the tool, the tool being operable by one person, said tool further comprising:

a framework for supporting the interior panels during installation;

a clamp for attachment of the tool to wall or ceiling construction frames;

a quarter-round junction for joining the framework and the clamp together at one end of the tool proximal the clamp, to provide pre-installation and installation elevation or depression angles of the tool and to compensate potential relative deflection of a construction frame material caused by a load on the tool loaded with the interior panels on it.

2. The apparatus according to claim 1, wherein said clamp further comprises:

two pairs of jaws, each jaw including a sliding rod channel therein, and where an inside of each jaw in each pair has an antifriction shape which is at least a ribbed or studded surface;

two paralleled sliding rods shaped at least as cylinders or rectangular prisms and traversing through respective channels of said jaws and through said quarter-round junction;

two compressing levers connected with a handle, each said lever being fork shaped and eccentrically connected to said jaws and said sliding rods with shafts.

3. The apparatus according to claim 2, wherein:

said quarter-round junction is connected to said clamp by means of said sliding rods and at least two bolts to the pair of jaws, and comprising:

a quarter-round guide having a plate shape as at least a quarter round and including:

two sliding rod channels;

a main pivot channel; and a levelling channel.

4. The apparatus according to claim 2, wherein said framework comprises:

a main arm which is at least a rectangular tube with a quarter round guide channel, a main pivot channel; a medium section of said main arm has a smaller profile size;

a main pivot, which is at least a main pivot cylinder connecting said main arm with said quarter round junction through said main pivot channel and providing limited rotation of said main arm on it;

a crossbar, which is at least a rectangular tube, placed on said main arm perpendicularly and sliding on it by the crossbar channel in said crossbar within limits of said medium section of said main arm;

a right arm, which is at least a rectangular tube connected to said crossbar with a first crossbar pivot which provides limited rotation of said right arm on it as well as sliding of said right arm inside said crossbar;

a left arm, which is at least a rectangular tube connected to said crossbar with a second crossbar pivot which provides limited rotation of said left arm on it as well as sliding of said left arm inside said crossbar;

a right semi-arm, which is at least a rectangular tube connected to said right arm with a right arm pivot, which provides limited rotation of said right semi-arm on it;

a left semi-arm, which is at least a rectangular tube connected to said left arm with a left arm pivot that provides limited rotation of said left semi-arm on it;

a right supporting shaft, which is at least a right cylinder sliding through said right semi-arm;

a left supporting shaft, which is at least a left cylinder sliding through said left semi-arm;

a main arm extension section, which is at least a rectangular tube providing an extension of said main arm and containing a security anchor channel; said extension section as well rotates on an axis which is at least said cylinder connected to said main arm;

a security anchor, which is at least a security cylinder with threads on one side of it and at least a round handle on another side, and sliding through said main arm extension section;

a levelling transmission, which is placed inside said main arm and consists of:

a control lever unit, mount, shaft, rod, compressing spring, fork and levelling shaft which traverses through said levelling channel of said quarter round guide.

5. A method for installation of interior panels on vertical and horizontal framed surfaces without using a floor as a supportive base for an installation tool comprising:

attaching the installation tool to a construction frame of a ceiling or a wall without using the floor as the supportive base by clamping the tool with plural clamps on the construction frame in order to install an interior panel, loading an interior panel on the installation tool, raising the tool and the interior panel loaded on the installation tool to a desired installation position in preparation for attaching the interior panel, and subsequently attaching the interior panel.

6. The method of claim 5, wherein the method further comprises:

the construction frame is a ceiling construction frame, the interior panel is a ceiling panel, and attaching the ceiling panel to the ceiling.

7. The method of claim 5, wherein the method further comprises:

the construction frame is a wall construction frame, and the interior panel is a wall panel and attaching the wall panel to the wall.

8. The method according to claim 5, the raising of the tool and the internal panel further comprising:

upswinging said framework to a panel installation spot, levelling the tool by a control lever and securing the tool by a security anchor; before attaching the interior panel to the construction frame.

9. The method according to claim 5, wherein the attaching the installation tool by the clamps comprises clamping the clamps to a ceiling construction frame at a point required for precise panel installation;

wherein the loading comprises deploying the tool and then loading it with the ceiling panel;

wherein the raising comprises upswinging said tool to an installation spot, levelling the tool by a control lever and securing the tool by a security anchor; before attaching the ceiling panel to the ceiling construction frame.

10. A Wall-to-Wall method for installation of interior panels on vertical and horizontal framed surfaces without using a floor as a supportive base for an installation tool comprising:

attaching the installation tool to a wall construction frame without using the floor as the supportive base by clamping the tool on the wall construction frame, loading a wall panel on the installation tool in order to install the wall panel and subsequently installing the wall panel.

11. The method according to claim 10, further comprising:

wherein the attaching the installation tool by clamping the tool comprises clamping the tool to the wall construction frame at a point required for precise panel installation;

wherein the loading of the wall panel on the tool comprises deploying the tool and the loading comprises loading the tool with a wall panel;

wherein the raising of the tool comprises upswinging said tool to the point required; and attaching the wall panel to the wall construction frame.

* * * * *